US008550213B2

(12) United States Patent
Jorkama-Lopez et al.

(10) Patent No.: US 8,550,213 B2
(45) **Date of Patent: *Oct. 8, 2013**

(54) SCAFFOLD ELEMENT, ARRANGEMENT AND METHOD OF USE

(75) Inventors: Tomas Alberto Jorkama-Lopez, Porvoo (FI); Hannu Ojantausta, Espoo (FI)

(73) Assignee: Moldtech Oy, Espoo (FI)

( * ) Notice: Subject to any disclaimer, the term of this patent is extended or adjusted under 35 U.S.C. 154(b) by 215 days.

This patent is subject to a terminal disclaimer.

(21) Appl. No.: 12/934,014

(22) PCT Filed: Apr. 9, 2009

(86) PCT No.: PCT/FI2009/050272

§ 371 (c)(1), (2), (4) Date: Nov. 28, 2010

(87) PCT Pub. No.: WO2009/125070

PCT Pub. Date: Oct. 15, 2009

(65) Prior Publication Data

US 2011/0067955 A1 Mar. 24, 2011

(30) Foreign Application Priority Data

Apr. 11, 2008 (FI) ..... 20080121 U
Apr. 11, 2008 (FI) ..... 20080122 U
Apr. 11, 2008 (FI) ..... 20080123 U

(51) Int. Cl.
*E01D 22/00* (2006.01)

(52) U.S. Cl.
USPC ..... 182/112; 182/113; 182/150; 249/20; 249/24

(58) Field of Classification Search
USPC ..... 182/112, 113, 150; 249/24, 20; 14/77.1, 78
See application file for complete search history.

(56) References Cited

U.S. PATENT DOCUMENTS 3,595,510 A * 7/1971 Hutchinson ..... 248/175
3,901,481 A * 8/1975 Probst ..... 256/59

(Continued)

FOREIGN PATENT DOCUMENTS

DE 196 40 396 A1 4/1998
DE 19922005 A1 11/2000

(Continued)

OTHER PUBLICATIONS

Chinese Office Action in corresponding Chinese Application No. 200980112789 dated Mar. 30, 2012.

(Continued)

*Primary Examiner* — Alvin Chin Shue
*Assistant Examiner* — Colleen M Chavchavadze
(74) *Attorney, Agent, or Firm* — Potomac Patent Group, PLLC

(57) ABSTRACT

The invention concerns a scaffold element adapted to be removably attachable to a bridge, the scaffold element comprising support member for supporting the scaffold element onto an upper surface of the bridge and a support structure which is secured to the support members and which extends to a distance outside the edge of the bridge and to a distance below the bridge. The invention is characterized in that the scaffold element further comprises a longitudinally adjustable support bar pivotally connected to the support structure and being supportable against a lower surface of the bridge and adjustment means for adjustably attaching a vertical mold wall onto the support structure of the scaffold element at a distance outside the edge of the bridge for forming a mold between the wall and the bridge. Also a scaffold arrangement and method of use are disclosed.

16 Claims, 9 Drawing Sheets

(56) References Cited

U.S. PATENT DOCUMENTS

Figure 1:
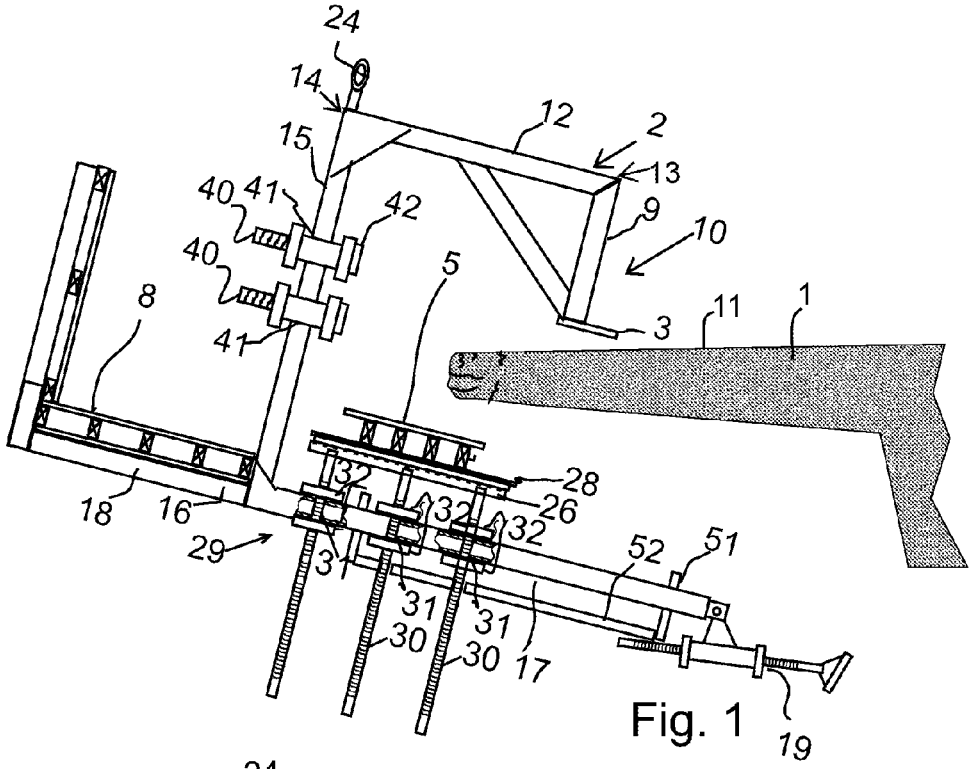

| | | | | |
|---|---|---|---|---|
| 3,985,480 | A * | 10/1976 | Finsterwalder | 425/63 |
| 4,103,861 | A * | 8/1978 | Buchler et al. | 249/20 |
| 4,123,031 | A * | 10/1978 | Hyre | 249/24 |
| 4,260,126 | A * | 4/1981 | Schreck et al. | 249/20 |
| 4,453,619 | A * | 6/1984 | Bierman | 182/142 |
| 4,660,800 | A * | 4/1987 | Horstketter | 249/24 |
| 5,549,176 | A * | 8/1996 | Hawkins | 182/63.1 |
| 5,755,981 | A * | 5/1998 | Payne | 249/24 |
| 6,038,829 | A * | 3/2000 | Franks | 52/645 |
| 8,136,191 | B2 * | 3/2012 | Jorkama-Lopez et al. | 14/78 |
| 2002/0139614 | A1 * | 10/2002 | Volkman | 182/82 |
| 2005/0217040 | A1 * | 10/2005 | Jackson | 14/77.1 |
| 2010/0175205 | A1 * | 7/2010 | Jorkama-Lopez et al. | 14/77.1 |
| 2011/0120800 | A1 * | 5/2011 | Depot | 182/113 |

FOREIGN PATENT DOCUMENTS

| | | | |
|---|---|---|---|
| JP | 2005232773 | A | 9/2005 |
| WO | 2008132277 | A1 | 11/2008 |

OTHER PUBLICATIONS

International Search Report for PCT/FI2009/050272 mailed Aug. 27, 2009.

Written Opinion for PCT/FI2009/050272 mailed Aug. 27, 2009.

* cited by examiner

SCAFFOLD ELEMENT, ARRANGEMENT AND METHOD OF USE

FIELD OF THE INVENTION

The invention relates to a scaffold element, arrangement and method of use of such element and arrangement.

BACKGROUND OF THE INVENTION

The edge structure, such as the edge beam, of a concrete bridge is often built separately after constructing the deck of the bridge. There thus is a need for a scaffold usable for building the edge structure. The edge structure is also susceptible to damage over time e.g. due to disintegration of the concrete, providing a need to repair the edge structure.

The closest prior art is represented by a scaffold arrangement comprising a casting mould and an access bridge supported onto the same scaffold that is suspended from the edge of the bridge. The arrangement comprises a number of bents arranged at a distance from each other for the length of the area of the bridge that needs repairing and supported onto the edge of the bridge by support members. The access bridge is supported onto the bents in order to form a passage for the duration of the repair period. Mould walls are supported onto the bents in order to form a concrete casting mould for casting the new edge structure for the bridge.

The problem with all known scaffold arrangements is that in order to provide a sufficiently tight mounting, the mounting of the scaffold has required the formation of holes extending through the entire deck of the bridge. In other words, the bents have been suspended by the bars extending through the above-mentioned holes. To mount such scaffolds, the workers have been forced to work for extended periods from underneath the bridge, by means of e.g. a passenger lift or, if possible, a so-called bridge crane positioned onto the deck. Long-term work on/under the bridge with lifting machines disturbs road traffic and often also railway traffic. Moreover, the mounting is difficult in bridges which cross waterways. With the known methods and arrangements, for example the construction of a scaffold arrangement required for repairing the edge beam of a bridge has taken a long time. Long mounting and repair periods hinder the traffic and increase the expenses. Furthermore, the present scaffolds are usually made of timber, so that the scaffolds are disassembled after the work is completed, and only a portion of the stouter timber may be reused, the rest ending up on a landfill site as unserviceable.

OBJECTIVE OF THE INVENTION

An objective of the invention is to eliminate the drawbacks referred to above.

One objective of the invention is to disclose a scaffold element which can be easily mounted so that as short working period as possible from underneath the bridge is required. A further objective of the invention is to disclose a method and an arrangement which enable a considerably faster repair of the edge structure of a bridge compared to the present situation.

Another objective of the invention is to disclose a scaffold element which can be used repeatedly several times in different locations and which can be adapted and adjusted to be suitable for almost all existing bridges.

Yet another objective of the invention is to disclose a scaffold element that enables convenient assembly of mould walls in the vicinity of the edge of a bridge.

Still yet another objective of the invention is to disclose a scaffold element and arrangement that allows easy setup and adjustment of vertical mould walls that may have e.g. a curved shape.

SUMMARY OF THE INVENTION

The scaffold element, arrangement and method according to the invention are characterized by what has been presented in the accompanying claims.

An aspect of the invention is a scaffold element adapted to be removably attachable to a bridge, the scaffold element comprising a support member for supporting the scaffold element onto an upper surface of the bridge and a support structure which is secured to the support member and which extends to a distance outside the edge of the bridge and to a distance below the edge of the bridge. The scaffold element is characterized in that it further comprises a longitudinally adjustable support bar pivotally connected to the support structure and being supportable against a lower surface of the bridge and adjustment means for adjustably attaching a vertical mould wall onto the support structure of the scaffold element at a distance outside the edge of the bridge for forming a mould between the wall and the bridge.

In an embodiment, the support structure comprises a column comprising a vertical component. The lower end of the column extends to a distance down from the edge of the bridge.

In an embodiment, the support structure comprises a beam having a horizontal component secured rigidly to the column.

In an embodiment, the support structure comprises adjustment means for adjustably supporting the vertical mould wall e.g. onto the column of the support structure. The adjustment means may be adapted to push the mould wall towards the bridge and suitably maintain the pushing force or pull the mould wall away from the bridge and suitably maintain the pulling force.

In an embodiment, the adjustment means comprises at least one adjustment screw that is supported onto e.g. the column of the support structure, suitably into a horizontal position. Suitably, there are at least two adjustment screws.

The adjustment screw may comprise a holding member for holding securely the mould wall.

In an embodiment, the support structure comprises adjustment means for adjustably supporting a horizontal mould wall onto the horizontal beam of the scaffold element.

In an embodiment, the support structure comprises a vertical beam which may be e.g. substantially vertical and made of e.g. steel and in which beam the lower end can be anchored by support members to the upper surface of the bridge at a distance from the edge of the bridge that needs repairing, the beam extending to a distance above the upper surface of the bridge. The support structure may further comprise an upper horizontal beam in which the first end is rigidly secured to the upper end of the vertical beam and which horizontal beam extends from the vertical beam e.g. substantially horizontally and substantially transversely relative to the longitudinal direction of the bridge in such manner that the second end of the upper horizontal beam extends over the edge of the bridge to a distance from the edge of the bridge. The support structure may yet further also comprise a vertical column, secured vertically at the upper end to the second end of the upper horizontal beam, the lower end of the vertical column extending to a distance down from the edge of the bridge.

The beam having a horizontal component (in the embodiment shown herein referred also as "the lower horizontal beam") may be rigidly secured to the column having a vertical component and extend from the column e.g. substantially horizontally and substantially transversely relative to the longitudinal direction of the bridge.

The lower horizontal beam may comprise a first beam portion extending from the vertical column to a distance below the bridge, so that said mould walls can be fitted onto the first beam portion. The lower horizontal beam may further comprise a second beam portion extending from the vertical column to an opposite direction relative to the first beam portion and supporting the access bridge.

In one embodiment of the scaffold element, a mounting flange is rigidly secured to the lower end of the vertical beam. The mounting flange comprises long holes which extend substantially transversely relative to the longitudinal direction of the bridge. Anchor bolts can be secured through the long holes to the bridge. In one embodiment of the arrangement, the scaffold element comprises a suspension member which can be grabbed. The suspension member is arranged to be offset from the mass centre of the scaffold element (also referred to as "bent") so that when lifted by the suspension members, the bents are tilted in such manner that during mounting of the bents, the mounting flange is first supported at the edge to the upper surface of the bridge at a contact point, and when the scaffold element is lowered further the mounting flange turns about said contact point, until it is in alignment with the upper surface and rests against it.

In one embodiment, the scaffold element comprises a holder in which the level can be adjusted vertically and onto which mould walls can be supported.

In one embodiment of the scaffold element, the holder is guided to move vertically in the guidance of the vertical column.

In one embodiment of the scaffold element, the holder comprises an adjustment member for moving the mould walls horizontally. In one embodiment of the scaffold element, the bent comprises a lifting device arranged to operate between the holder and the first beam portion in order to adjust the level of the holder.

In one embodiment of the scaffold element, the lifting device comprises a lifting screw, wherein the holder is arranged onto the upper end of the lifting screw and the lifting screw extends through a hole in the first beam portion. Locking nuts are arranged into the first beam portion in order to lock the lifting screw. In one embodiment of the arrangement, the lifting device is a mechanical or hydraulic jack.

In one embodiment of the scaffold element, the element comprises a vertical support member connected to the upper horizontal beam at a distance from the vertical beam.

In one embodiment of the scaffold element, the vertical support member is adapted to operate as a supporting foot for the bent during mounting.

In one embodiment of the scaffold element, the vertical support member is rigidly secured to the upper horizontal beam.

In one embodiment of the scaffold element, the vertical support member is adapted to move horizontally in the guidance of the upper horizontal beam, and it comprises locking members for detachably locking it to its position. The vertical support member is adapted to touch the surface of the bridge. In an embodiment, the vertical support member is longitudinally adjustable.

In one embodiment, the adjustment means for supporting the vertical mould wall onto the column of the scaffold element are adapted to push the vertical mould wall horizontally towards the bridge or pull the vertical mould wall horizontally away from the bridge.

In an embodiment, the adjustment means comprise at least one adjustment screw that is horizontally supported to the column. The adjustment screw may comprise an attachment member for attaching the vertical mould wall to the screw. Suitably, there are two or more adjustment screws.

One aspect of the invention is a scaffold arrangement comprising at least two scaffold elements placed at a distance from each other. Access bridge element may be supported onto the scaffold elements. Further, the adjustable mould wall elements may be supported onto the plurality of scaffold elements.

In an embodiment, the arrangement comprises a working platform supported onto at least one scaffold element underneath the bridge. The working platform is suitably supported so on the scaffold element or between two scaffold elements that a worker is able to operate the longitudinally adjustable support bar from the platform. Conveniently, the working platform is adapted to be rigid enough to support the weight of a worker, e.g. 100 kg.

In one embodiment, the arrangement comprises a receiving member for receiving the rubble removed from the edge of the bridge. The receiving member can be supported onto the holders.

In one embodiment of the arrangement, the mould walls comprise at least one horizontal mould wall which limits the casting in a downward direction and at least one vertical mould wall which limits the casting in a lateral direction.

In one embodiment of the arrangement, the vertical mould walls comprise a first vertical mould wall for limiting the casting in a first lateral direction, and a second vertical mould wall for limiting the casting in a second lateral direction which is an opposite direction relative to the first lateral direction.

In one embodiment of the arrangement, the second vertical mould wall is connected to the vertical support.

In one embodiment of the arrangement, the arrangement further comprises a horizontal shoring that is detachably supportable onto the adjustment means of horizontal mould wall of two scaffold elements that reside in a distance from each other. The shoring comprises support elements that are longitudinally adjustable. Suitably, the support element comprises a telescopic structure. The horizontal mould wall may be supported on top of the support elements of the shoring.

An aspect of the invention is a method of installing the scaffold element onto a bridge. When installing the scaffold element onto a bridge, the support structure of the scaffold element is fixedly anchored by at least one support member to the upper surface of the bridge at a distance from the edge of the bridge that needs repairing. This method provides the advantage that the scaffold element can be mounted by working from the top of the bridge, which reduces considerably the time required for the repair work. The scaffold element is quickly mounted and disassembled, saving costs and reducing the traffic disturbance. The scaffold element is safe for those trafficking below. There is no disturbance for the traffic below the bridge. There is little or no need to drill thorough holes into the deck of the bridge that would later have to be patched up. Being advantageously metal-structured, the arrangement is strong and it can be used repeatedly several times all over again in different locations and be adapted and adjusted to be suitable for almost all existing bridges.

In one embodiment of the method, the scaffold element of the present invention is moved to its position to the edge of the bridge that needs repairing by lifting it in a tilted position by the suspension members in such manner that the edge of the bridge is set between the mounting flanges and the holders. Then the tilted scaffold element is lowered so that the mounting flange contacts the upper surface of the bridge. The scaffold element is lowered further so that the mounting flange becomes aligned with the upper surface of the bridge. The mounting flange is secured to the upper surface of the bridge by the anchor bolts. The scaffold element is supported onto the lower surface of the bridge by the longitudinally adjustable support bars.

In one embodiment of the method, when the mounting flange is being secured to the upper surface of the bridge, the position of the scaffold element is adjusted by placing wedges between the mounting flange and the upper surface of the bridge.

In one embodiment of the method, a receiving member is arranged onto the holders for receiving the rubble. The holders and the receiving member are lifted by the lifting device in such manner that the receiving member comes close to the edge of the bridge that needs repairing. After that, old concrete is removed from the area to be renewed at the edge of the bridge and the rubble is received onto the receiving member. The rubble is removed from the receiving member and it is carried away along the access bridge.

In one embodiment of the method, the horizontal mould wall and the first vertical mould wall are supported onto the holders, and, optionally, the second vertical mould wall is supported onto the vertical support. The edge of the horizontal mould wall is placed tightly against the lower surface of the bridge. The distance of the first vertical mould wall from the edge of the bridge is adjusted using the adjustment means and, at the lower end, tightly against the horizontal mould wall and it is moved horizontally to a distance from the remaining edge of the bridge after the removal of the old concrete.

In one embodiment of the method, the first vertical mould wall is first attached to the holding members of first and third scaffold elements and then attached to the holding members of a second scaffold element residing between the first and third scaffold elements. The adjustment screws of the second scaffold element are then used to bend the vertical mould wall by pushing or pulling the mould wall. This way the mould wall may be conveniently installed and adapted to form a curve that e.g. matches the curved form of a bridge.

In one embodiment of the method, the vertical support is adjusted horizontally, if such adjusting possibility is arranged, in order to position the second vertical mould wall, and is locked to its position by the locking members. A new edge beam or other edge extension is cast from concrete into the space bounded by the first vertical mould wall, the horizontal mould wall, the optional second vertical mould wall and the remaining edge of the bridge after the removal of the old concrete.

In one embodiment of the method, the holders are lowered by the lifting device after hardening of the cast concrete in order to remove the horizontal mould wall from the cast edge beam or other extension. The support bars are loosened. The anchor bolts are loosened so that the mounting flange can be moved horizontally relative to the upper surface of the bridge. Optionally, the second vertical mould wall is moved away from the cast edge beam etc. by moving the vertical support. The scaffold elements are moved transversely relative to the longitudinal direction of the bridge within the limits set by the long holes of the mounting flange in order to remove the first vertical mould wall from the cast edge beam or other extension.

In one embodiment of the method, the vertical mould walls are removed. Then the holders are lowered by the lifting device and the horizontal mould wall is removed from the holders. The access bridge is removed from the bents. The support members, such as the anchor bolts, are removed. Finally, the bents are moved away from the edge of the repaired bridge by grabbing the suspension members and lifting the bents away from the edge of the bridge.

LIST OF FIGURES

Figure 2:
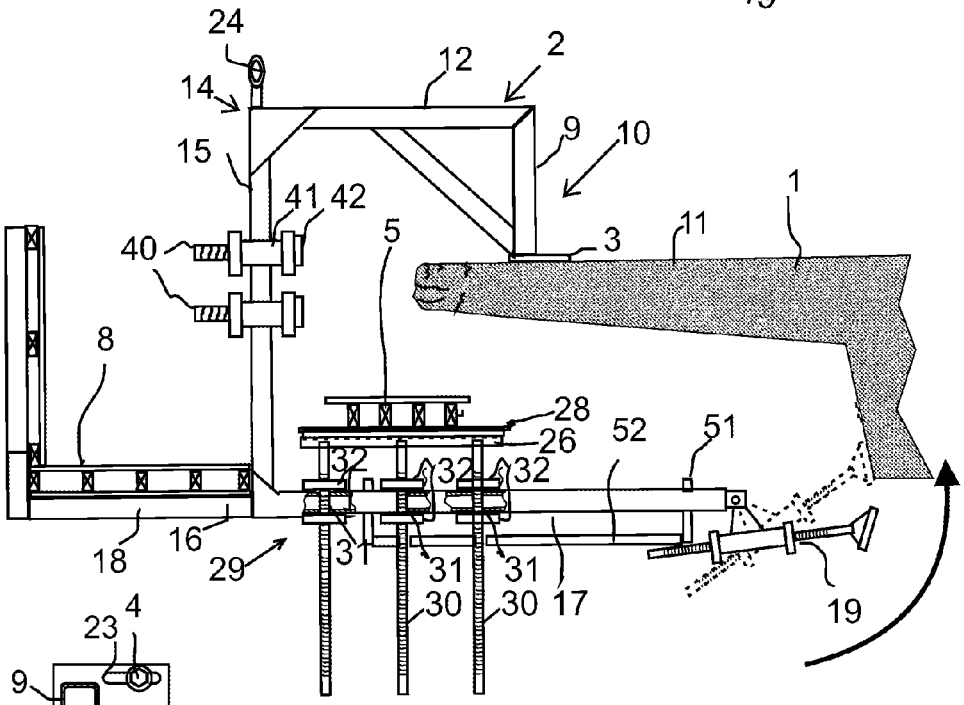
Figure 2A:
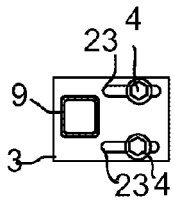
Figure 8:
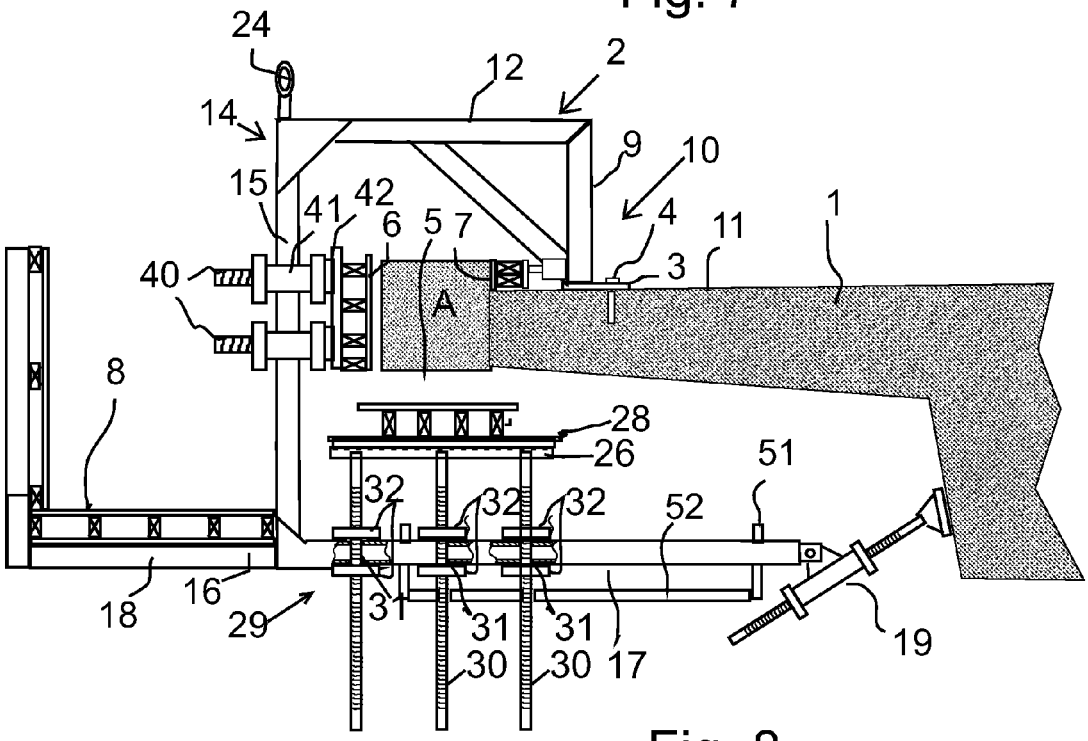
Figure 9:
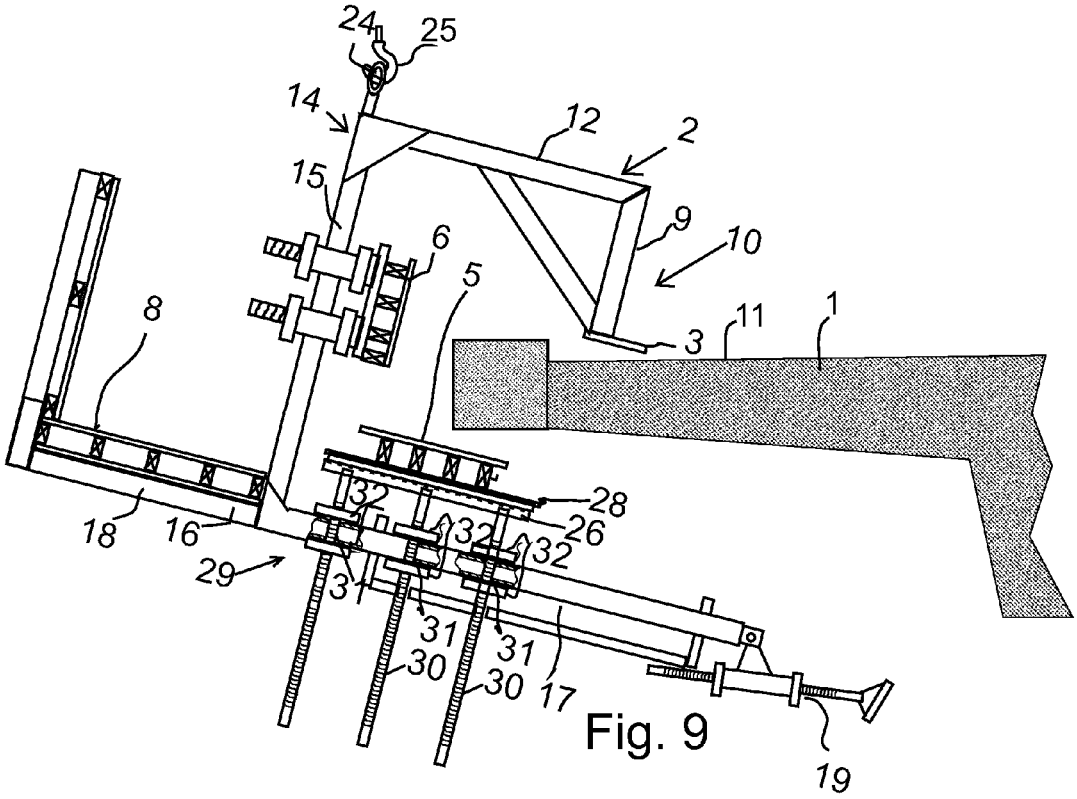
Figure 10:
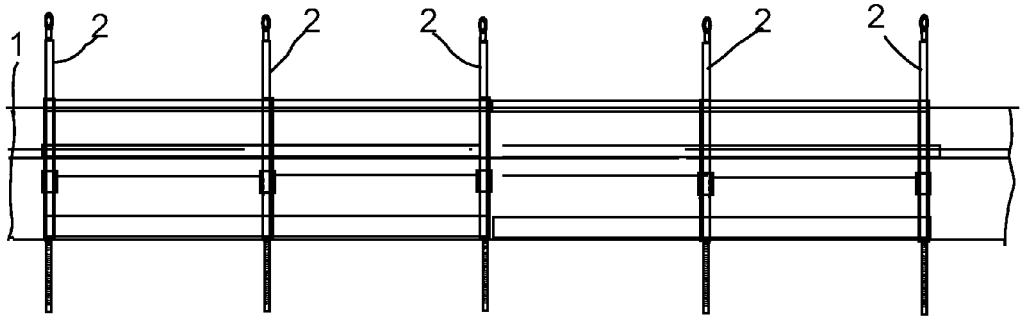
Figure 11:
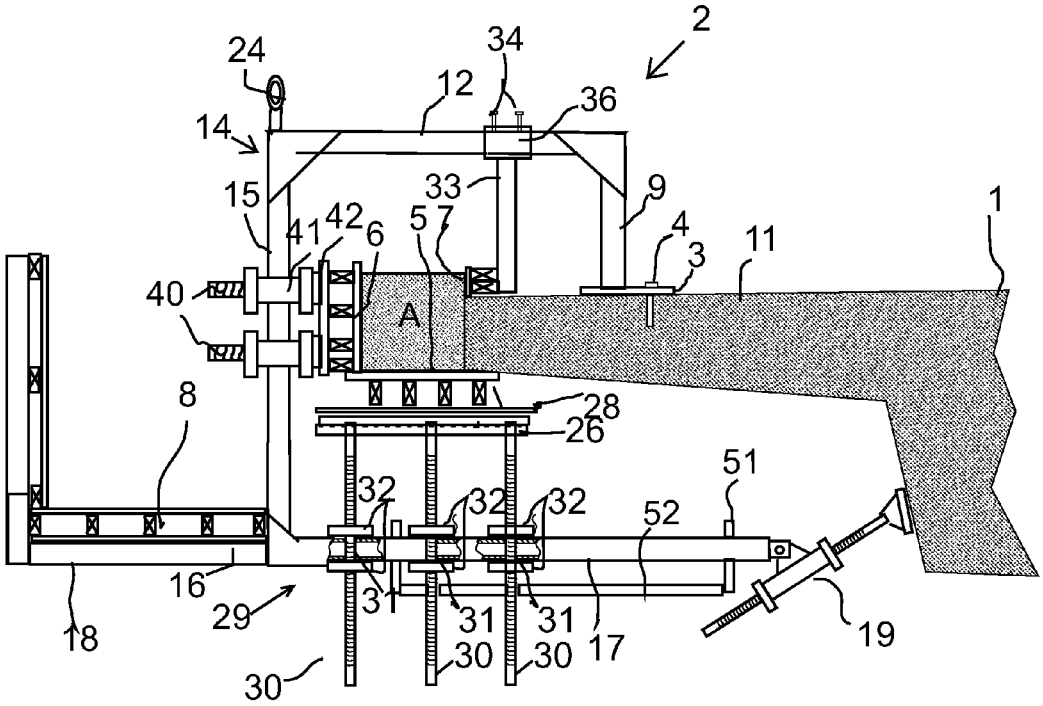
Figure 12:
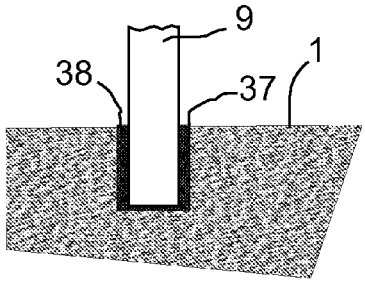
Figure 13:
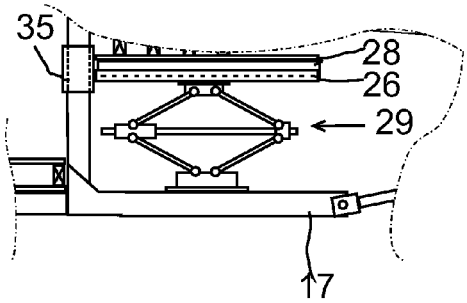
Figure 14:
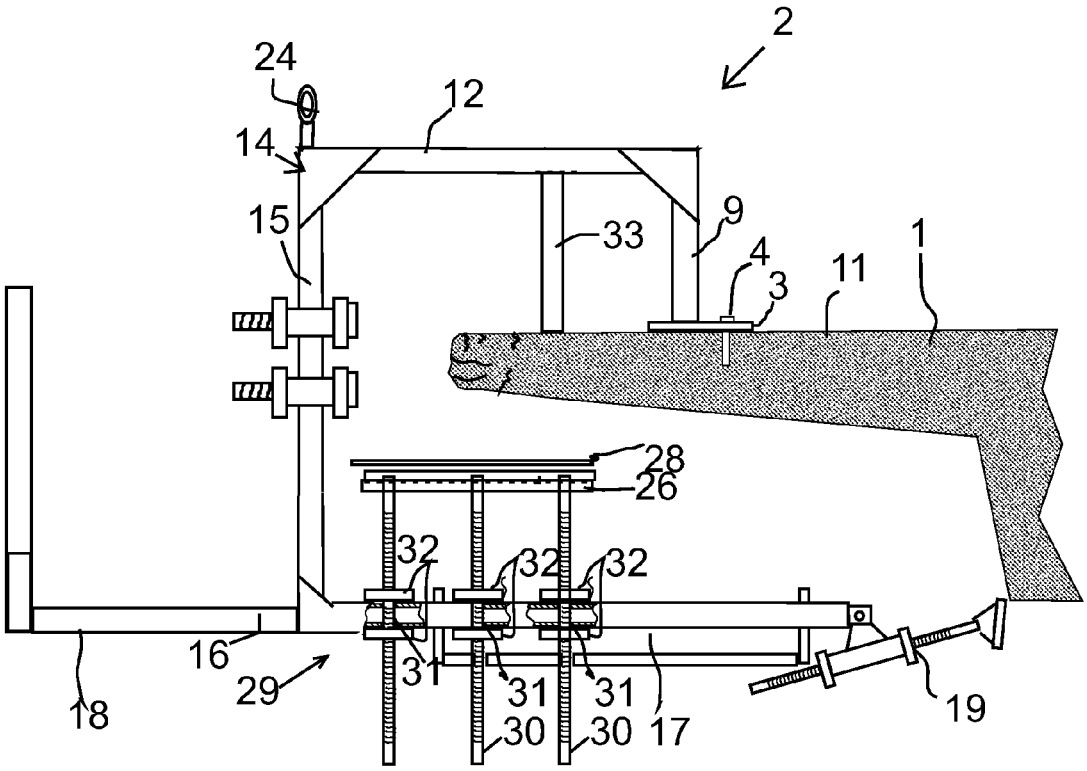
Figure 15:
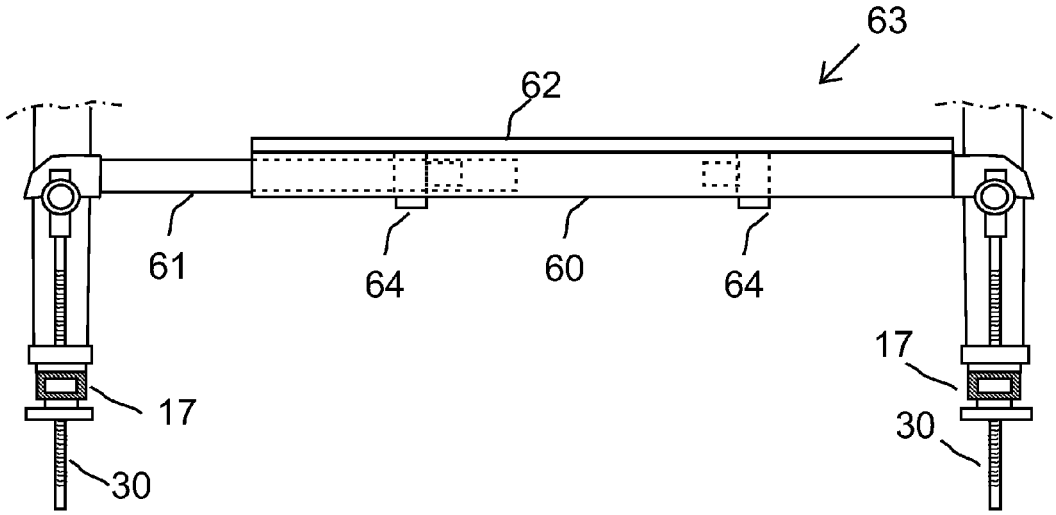
Figure 16:
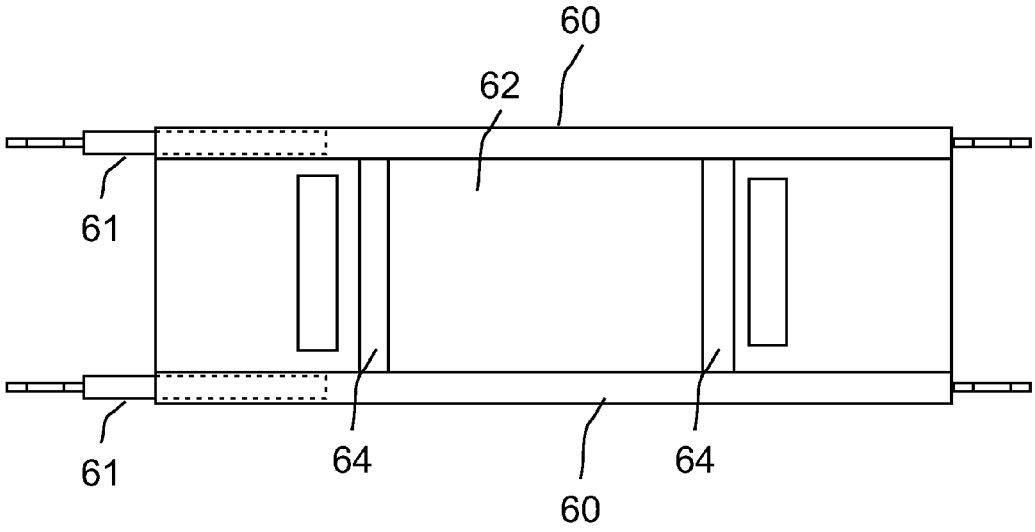
Figure 17:
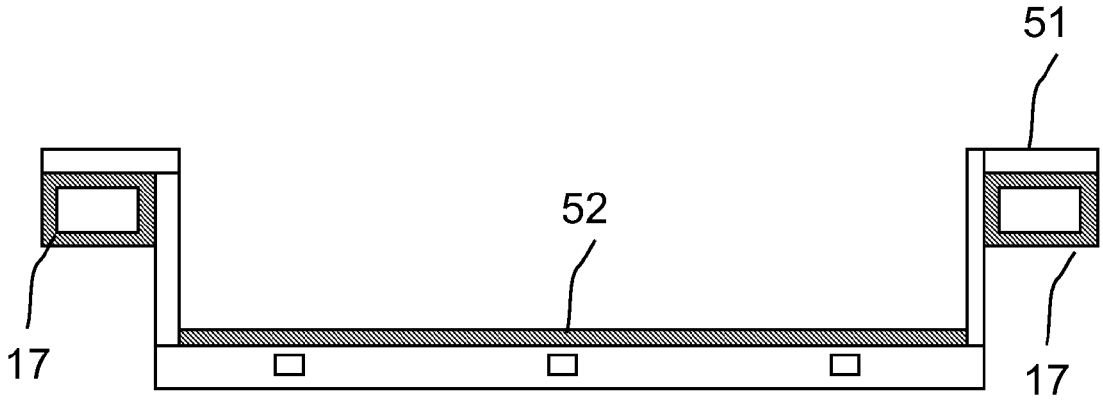

In the following section, the invention will be described in detail by means of exemplifying embodiments with reference to the accompanying drawing in which FIG. 1-9 show a first embodiment of the arrangement according to the invention at different steps of the method according to the invention, FIG. 2*a* shows section II-II of FIG. 2, FIG. 10 shows schematically the adjacent bents of the arrangement of FIG. 1-9, mounted successively to the edge of the bridge, as seen from the side of the bridge, FIG. 11 shows a second embodiment of the arrangement according to the invention at one step of the method, FIG. 12 shows a detail of an alternative securing of the lower end of the vertical beam of the bent to the deck of the bridge, FIG. 13 shows an alternative lifting device, FIG. 14 shows a third embodiment of the arrangement according to the invention at a step of the method that corresponds to FIG. 2, FIGS. 15 and 16 show a horizontal shoring according to an embodiment of the invention, and FIG. 17 shows a working platform according to an embodiment of the invention.

DETAILED DESCRIPTION OF THE INVENTION

FIGS. 1-10 show the scaffold element to be mounted on the upper surface of a concrete bridge in order to repair a concrete edge structure of the bridge. FIGS. 1-9 show the bridge in cross-section. As seen from the side view in FIG. 10, in the arrangement a number of scaffold elements 2 are arranged at a distance from each other along the length of the portion of the bridge that needs to be repaired. For example when renewing the edge beam of the bridge or broadening the deck of the bridge, the scaffold arrangement is usually constructed to extend over the entire length of the bridge.

FIG. 1-9 show one scaffold element 2. Suitably, all elements 2 in the arrangement are identical.

The scaffold elements 2 are supported by support members 3, 4 onto the upper surface close to the edge of the bridge, as will be described below. Mould walls 5, 6, 7 can be supported onto the scaffold elements 2 to form a concrete casting mould for casting a new edge structure for the bridge. The scaffold arrangement also comprises an access bridge 8 supported onto the scaffold elements 2 in order to form a passage and a working platform for the duration of the repair period. The scaffold element 2 comprises in a vertical direction a vertical steel beam 9 in which the lower end 10 can be anchored by the support members 3, 4 to the upper surface 11 of the bridge at a distance from the edge of the bridge that needs to be repaired. The vertical beam 9 extends to a distance above the upper surface 11 of the bridge. The first end 13 of an upper horizontal steel beam 12 is rigidly secured to the upper end of the vertical beam 9. The upper horizontal beam 12 extends from the vertical beam 9 horizontally and substantially transversely relative to the longitudinal direction of the bridge in such manner that the second end 14 of the upper horizontal beam 12 extends over the edge of the bridge to a distance from the edge of the bridge. A vertical steel column 15 is vertically secured at the upper end to the second end of the upper horizontal beam 12. The lower end of the vertical column extends to a distance down from the edge of the bridge. A lower horizontal steel beam 16 is secured rigidly to the vertical column 15 and extends from the vertical column 15 horizontally and substantially transversely relative to the longitudinal direction of the bridge. The lower horizontal beam 16 comprises a first beam portion 17 extending from the vertical column 15 to a distance below the bridge. Said mould walls 5, 6 can be fitted onto the first beam portion 17. A second beam portion 18 of the lower horizontal beam 16 extends from the vertical column 15 to an opposite direction relative to the first beam portion 17. The access bridge 8 is supported onto the second beam portion 18. A longitudinally adjustable support bar 19 is pivotally connected at one end to the first beam portion 17 and at the other end is supportable against the lower surface of the bridge. A flange positioned against the lower surface of the bridge may be connected by joints to the support bar 19.

In one preferred embodiment, the scaffold elements 2 are spaced at intervals of two meters and the access bridge 8 preferably comprises a prefabricated structure, so that for example 4 or 6 meters long access bridge elements 8 can be used, and, correspondingly, the mould walls 5, 6, 7 are preferably mould wall elements having the length of preferably 2 or 4 meters. These can be placed onto the bents, while the ribs are positioned in a staggered configuration. A mounting flange 3 is rigidly secured to the lower end of the vertical beam 9 and is shown from the top in FIG. 2*a*. The mounting flange 3 comprises long holes 23 extending substantially transversely relative to the longitudinal direction of the bridge. Anchor bolts 4 can be secured to the bridge through the long holes 23. Connected to the bent 2 is a suspension member 24 which in this context is a staple which can be grabbed by a grabbing member 25 of a lifting device, such as the lifting hook in FIG. 9. The suspension member 24 is slightly offset from the mass centre of the scaffold element 2, so that when lifted by the suspension members 24, the scaffold elements 2 are tilted as shown in FIG. 1, so that during mounting of the scaffold element 2, the mounting flange 3 is first supported at the edge onto the upper surface 11 of the bridge at a contact point, and when the scaffold element 2 is lowered further, the mounting flange 3 turns about the above-mentioned contact point until it is aligned with the upper surface 11 and rests against it. Each scaffold element 2 comprises a holder 26, vertically moveable by the lifting device 29 and in the guidance of the vertical column 15, for supporting the mould walls 5, 6 or a receiving member 27 for the rubble. The end of the holder 26 on the side of the vertical column accommodates a first sliding sleeve 35 which cooperates with the outer surface of the vertical column 15 in order to guide the movement of the holder 26 in a vertical direction.

The receiving member 27 supported onto the holders 26 is able to receive the rubble removed from the edge of the bridge. The receiving member 27 may be a rigid planar body or a flexible piece of tarpaulin cloth. Also the horizontal mould wall 5 supported onto the holders 26 can in principle be applied as the receiving member 27. The holder 26 also comprises an adjustment member 28 for moving the mould wall 5 horizontally. The holder 26 may be a U-shaped steel profile with a wooden beam sliding therein and forming the adjustment member 28. The scaffold element 2 further comprises a lifting device 29 operating between the holder 26 and the first beam portion 17 for adjusting the level of the holder 26. In the embodiment of FIG. 1-9, the lifting device 29 comprises three lifting screws spaced at a distance from each other. The holder 26 rests on the upper end of the lifting screws 30. The lifting screw 30 extends through a hole 31 in the first beam portion 17. The lifting screw can be tightened and locked in position by locking nuts 32.

FIG. 13 shows an alternative lifting device 29, a mechanical jack described herein in an exemplifying fashion and known from the context of vehicles. The jack 29 may as well be hydraulic.

Figure 5:
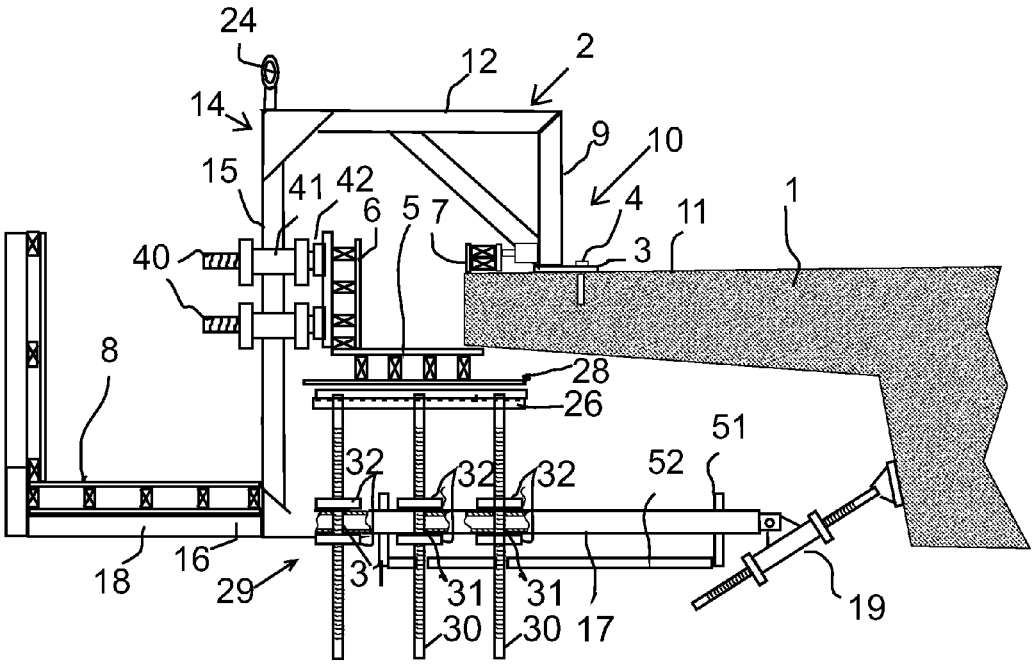
Figure 6:
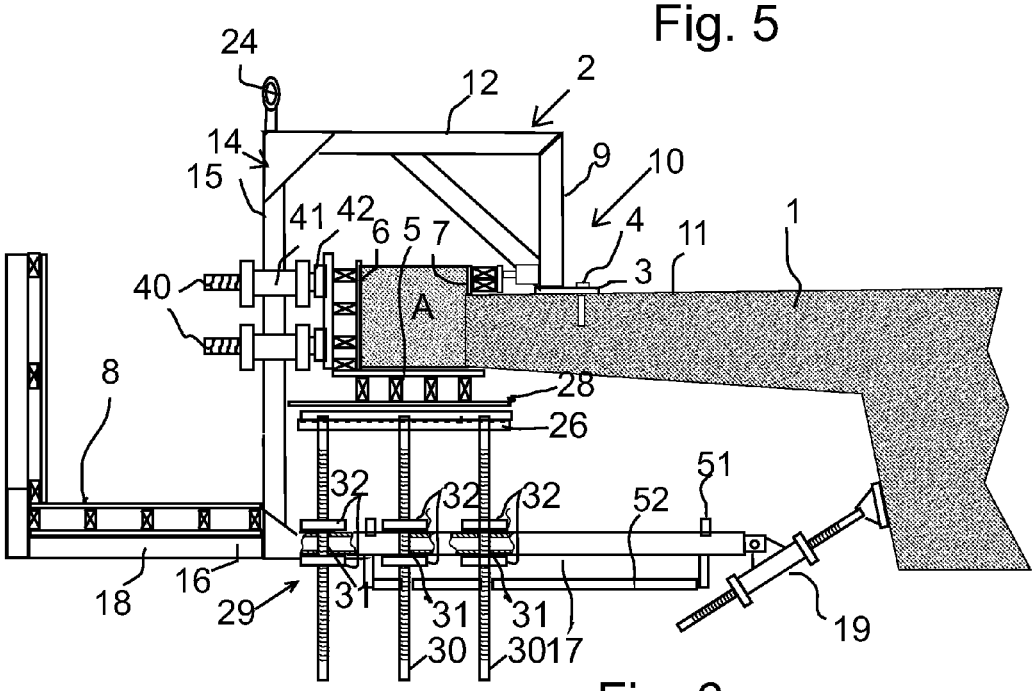

As seen from FIGS. 5 and 6, the mould walls 5, 6, 7 comprise a horizontal mould wall 5 which limits the casting in a downward direction, and two vertical mould walls 6, 7 which limit the casting in lateral directions. The first vertical mould wall 6 limits the casting in a first lateral direction, and the second vertical mould wall 7 limits the casting in a second lateral direction which is an opposite direction relative to the first lateral direction.

FIG. 11 shows an embodiment which corresponds with that described in the context of FIG. 1-9, except that the upper horizontal beam 12 is longer. Furthermore, a vertical support 33 is supported to move horizontally in the guidance of the upper horizontal beam 12. The second vertical mould wall 7 is supported onto the vertical support 33. The vertical support may be detachably locked in position by means of locking members 34. At the upper end of the vertical support 33 there is a second sliding sleeve 36 which cooperates with the outer surface of the upper horizontal beam 12 in guiding the vertical support 33 to move horizontally.

In the following section, the different steps of the method according to the invention will be described with reference to FIG. 1-10.

In FIG. 1, the scaffold element 2 is moved to its position to the edge of the bridge that needs to be e.g. repaired by lifting it in a tilted position by the suspension member 24 in such manner that the edge of the bridge is set between the mounting flange 3 and the holder 26. Thanks to the location of the suspension member 24 relative to the mass centre, the scaffold element 2 assumes this position automatically when it is hanging freely. The tilted scaffold element 2 is lowered so that the mounting flange 3 comes into contact with the upper surface 11 of the bridge. The scaffold element 2 is lowered further so that the mounting flange 3 becomes aligned with the upper surface 11 of the bridge as shown in FIG. 2.

In accordance with FIG. 2, the mounting flanges 3 at the lower ends 10 of the vertical beams 9 of the scaffold elements 2 are secured by the anchor bolts 4 to the upper surface 11 of the bridge to a distance from the edge of the bridge that needs to be repaired. When securing the mounting flange 3 to the upper surface 11 of the bridge, the position of the scaffold element 2 is adjusted by placing steel wedges between the mounting flange 3 and the upper surface 11 of the bridge, because the upper surface of the bridge is often uneven and rarely completely horizontal. Furthermore, the scaffold elements 2 are supported onto the lower surface of the bridge by the longitudinally adjustable support bars 19. The support bar 19 is conveniently operable from the working platform 52 supported onto the beam 17 using support members 51.

Figure 3:
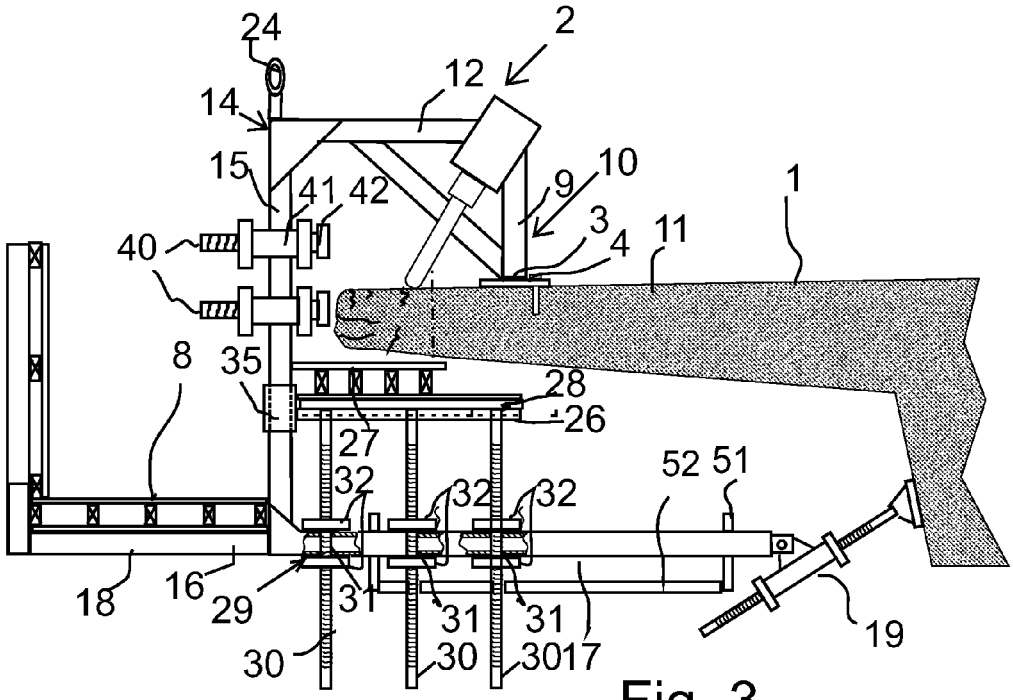
Figure 4:
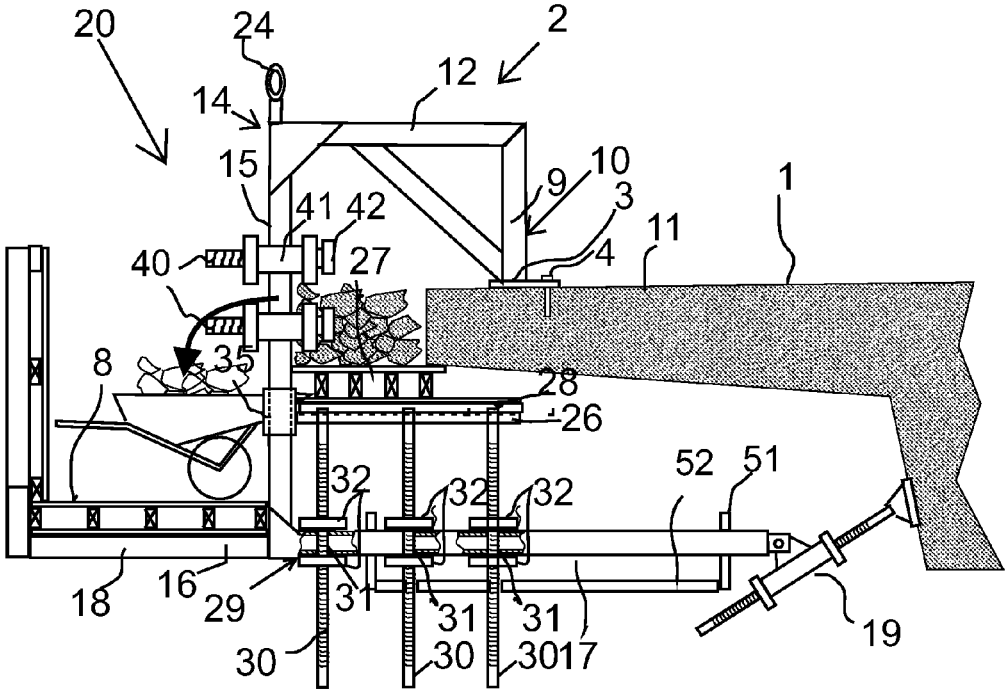

FIG. 3 shows that next, the access bridge elements 8 are arranged onto the second beam portion 18 of the lower horizontal beam 16. The receiving member 27 is arranged onto the holders 26 for receiving the rubble. The holders 26 are lifted by the lifting device 29 in such manner that the receiving member 27 comes close to and under the edge of the bridge that needs to be repaired. Old concrete is removed from the edge of the bridge over the area to be renewed, and the rubble is received onto the receiving member 27 as illustrated in FIG. 4. The rubble is removed from the receiving member 27 for example into a wheel-barrow and is carried away along the access bridge 8.

FIG. 5 shows that the horizontal mould wall 5 and the first vertical mould wall 6 are supported onto the holders 26. Furthermore, there is the second vertical mould wall 7. The edge of the horizontal mould wall 5 is positioned tightly against the lower surface of the bridge and the first vertical mould wall 6 is supported against the vertical columns 15, its lower end resting tightly against the horizontal mould wall 5. The first vertical mould wall 6 is placed at a distance from the remaining edge of the bridge after the old concrete has been removed. The distance is adjusted using the adjustment screws 40 which hold the mould wall 6 using a holding member 42. The screw 40 is attached in a horizontal position to the column 15 using an attachment member 41. In FIG. 6, a new edge beam A or other edge extension is cast from concrete into the space bounded by the first vertical mould wall 6, the horizontal mould wall 5 and the second vertical mould wall 7, and the remaining edge of the bridge after the removal of the old concrete.

Figure 7:
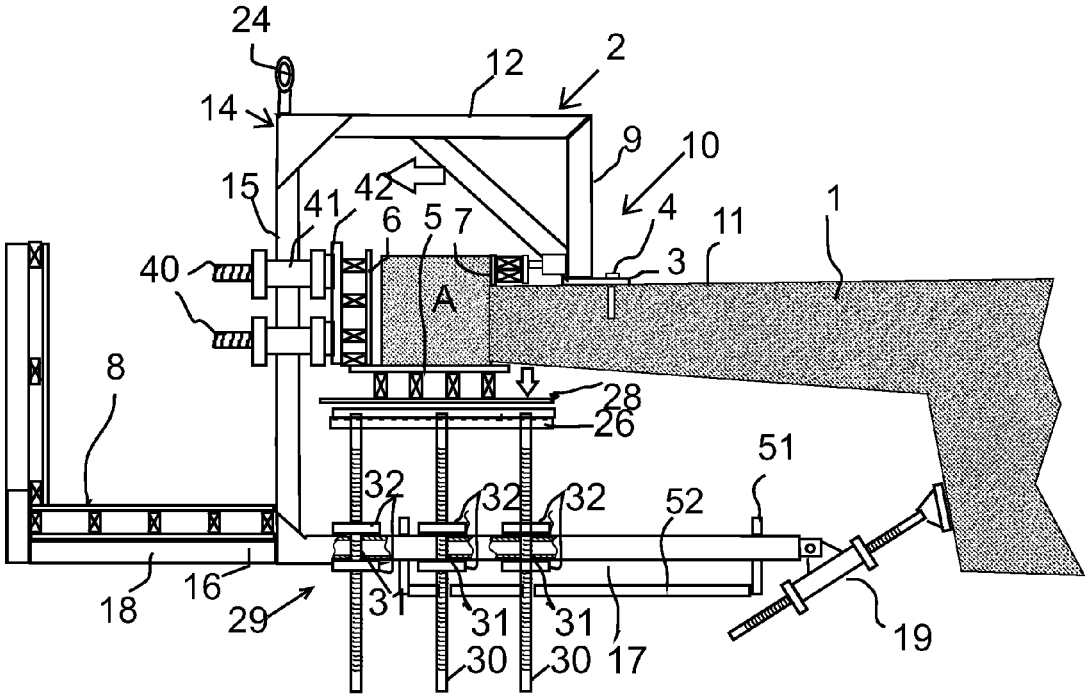

FIGS. 7 and 8 show that after the cast concrete has hardened, the holders 26 of the horizontal mould wall are slightly lowered by the lifting device 29 so that the horizontal mould wall 5 is detached from the lower surface of the cast edge beam or other extension. Also the holders 42 of the vertical mould wall are moved using the adjustment screws 40 to detach the vertical mould wall from the cast edge beam. After this, the vertical mould walls 6 can be removed. The support bars 19 are then loosened. The anchor bolts 4 are loosened so that the mounting flange 3 can be moved horizontally relative to the upper surface 11 of the bridge.

Then, in accordance with FIG. 8, the holders 26 are lowered by the lifting device in order to detach the horizontal mould wall 5 from the cast edge beam or other extension. The holders 26 are lowered by the lifting device 29 and the horizontal mould wall 5 is removed from the holders 26. The access bridge 8 is removed from the scaffold elements 2.

Then, in accordance with FIG. 9, the anchor bolts 4 are removed in order to remove the scaffold elements 2 one at a time, and the scaffold element 2 is moved away from the edge of the repaired bridge by grabbing again the suspension members 24 and lifting the bent 2 away from the edge of the bridge. The scaffold elements 2 are ready for instant reuse in another repair location.

FIG. 12 shows an alternative manner of supporting the vertical beam 9 of the scaffold element 2 onto the bridge. A non-thorough recess hole 37 is drilled into the upper surface of the bridge in order to insert the lower end of the vertical beam 9 therein. Soldering concrete 38 is cast into the recess hole around the vertical beam in order to fixedly secure the bent onto the deck of the bridge.

FIG. 14 shows yet one embodiment of a situation corresponding to the situation of FIG. 2 during mounting of the scaffold element to its position. The vertical support 33 is here fixedly secured to the upper horizontal beam 12 at a distance from the vertical beam 9. The vertical support 33 operates as a supporting foot supported onto the deck of the bridge, by which the scaffold element 2 can stand stably in the position of FIG. 14 when the support bar 19 is being placed against the lower surface of the bridge. In another embodiment, the vertical support 33 operating as the supporting foot may be adapted to move horizontally in the guidance of the upper horizontal beam 12, and it comprises locking members 34 for detachably locking it to its position in the manner similar to that described with reference to FIG. 11.

FIGS. 15 and 16 show a horizontal shoring 63 that is detachably supportable onto the adjustment means 30. The horizontal mould wall 5 may be supported onto the horizontal shoring. The shoring comprises two outer beams 60 into which two inner beams 61 are placed. The inner beams may slide inside the outer beams, thus forming a telescopic structure. The beams 60 together with support bars 64 form a rigid frame onto which a support plate is arranged. The telescopic structure of the horizontal shoring 63 allows a convenient placement of the shoring 63 between two scaffold elements 2 whose distance from each other may vary.

FIG. 17 shows the working platform 52 that is supported onto the beams 17 of two scaffold elements 2 using support members 51. The working platform is primarily needed when operating the support bar 19 of the scaffold element 2. The platform 52 is suitably positioned lower than the beams 17 to provide a sufficient working space below the bridge.

The invention is not limited merely to the exemplifying embodiments referred to above; instead many variations are possible within the scope of the inventive idea defined by the claims. For example, the support structure of the scaffold element may comprise any suitable shape, including arc, and it may comprise elements not mentioned in this disclosure. Also, although steel is mentioned as a suitable material of a scaffold element, any other suitable material may be used.

The invention claimed is:

1. A scaffold element adapted to be removably attachable to a bridge, the scaffold element comprising:

a support member for supporting the scaffold element onto an upper surface of the bridge and a support structure which is secured to the support member and which extends to a distance outside the edge of the bridge and to a distance below the edge of the bridge, wherein the scaffold element further comprises:

a longitudinally adjustable support bar pivotally connected to the support structure and being supportable against a lower surface of the bridge and adjustment means for adjustably attaching a vertical mould wall onto the support structure of the scaffold element at a distance outside the edge of the bridge for forming a mould between the wall and the bridge.

2. A scaffold element according to claim 1, wherein the support structure comprises a column comprising a vertical component and the column extending to a distance below the edge of the bridge.

3. A scaffold element according to claim 1, wherein the support structure comprises a beam having a horizontal component and secured rigidly to the column.

4. A scaffold element according to claim 2, wherein the adjustment means are adapted to push the vertical mould wall towards the bridge or pull the mould wall away from the bridge.

5. A scaffold element according to claim 4, wherein the adjustment means comprises at least one adjustment screw that is supported onto the column.

6. The scaffold element according to claim 1, further comprising a holder, the level of which can be vertically adjusted, and a horizontal mould wall which can be supported onto the holder.

7. The scaffold element according to claim 1, wherein the scaffold element comprises a suspension member which can be grabbed by a grabbing member of a lifting device, such as a lifting hook, and wherein the suspension member is arranged to be offset from the mass center of the scaffold element, so that when lifted by the suspension member, the scaffold element is tilted wherein during mounting of the support structure, the mounting flange is first supported at the edge to the upper surface of the bridge at a contact point, and as the scaffold element is lowered further, the mounting flange turns about said contact point until it is in alignment with the upper surface and rests against it.

8. The scaffold element according to claim 1, wherein the scaffold element comprises a vertical support connected to the support structure.

9. The scaffold element according to claim 8, wherein the vertical support is adapted to operate as a supporting foot for the scaffold element during mounting.

10. The scaffold element according to claim 8, wherein the vertical support is adapted to move horizontally in the guidance of the support structure, and it comprises locking means for detachably locking it to its position.

11. The scaffold element according to claim 10, wherein a second vertical mould wall is connected to the vertical support.

12. A scaffold arrangement comprising:

at least two scaffold elements at a distance from each other, wherein each of the at least two scaffold elements are adapted to be removably attachable to a bridge;

further wherein each of the at least two scaffold elements comprise:

a support member for supporting each of the at least two scaffold elements onto an upper surface of the bridge and a support structure which is secured to the support member and which extends to a distance outside the edge of the bridge and to a distance below the edge of the bridge, further comprising a longitudinally adjustable support bar pivotally connected to the support structure and being supportable against a lower surface of the bridge and adjustment means for adjustably attaching a vertical mould wall onto the support structure of each of the at least two scaffold elements at a distance outside the edge of the bridge for forming a mould between the wall and the bridge.

13. A scaffold arrangement according to claim 12, wherein the arrangement comprises a longitudinally adjustable horizontal shoring that is detachably supportable onto the adjustment means of a horizontal mould wall of two scaffold elements that reside at a distance from each other.

14. A scaffold arrangement according to claim 12, wherein the arrangement comprises a working platform supported onto at least one scaffold element underneath the bridge.

15. A scaffold arrangement according to claim 14, wherein the working platform is supported between two scaffold elements so that a worker is able to operate the longitudinally adjustable support bar from the working platform.

16. A method of installing a scaffold element, wherein the scaffold element comprises:

a support member for supporting the scaffold element onto an upper surface of the bridge and a support structure which is secured to the support member and which extends to a distance outside the edge of the bridge and to a distance below the edge of the bridge, wherein a longitudinally adjustable support bar pivotally connected to the support structure and being supportable against a lower surface of the bridge and adjustment means for adjustably attaching a vertical mould wall onto the support structure of the scaffold element at a distance outside the edge of the bridge for forming a mould between the wall and the bridge, wherein the scaffold element is moved to its position to the edge of the bridge by lifting it in a tilted position by suspension members further wherein the edge of the bridge is set between mounting flanges and holders, the tilted scaffold element is lowered so that the mounting flange comes into contact with the upper surface of the bridge, the scaffold element is lowered further so that the mounting flange becomes aligned with the upper surface of the bridge, the mounting flange is secured by anchor bolts to the upper surface of the bridge, and the scaffold element is supported onto the lower surface of the bridge by turning the longitudinally adjustable support bar into a support position.

* * * * *